United States Patent [19]

Ross

[11] Patent Number: 5,009,216

[45] Date of Patent: Apr. 23, 1991

[54] BOW DRAW STOP

[76] Inventor: Lawrence M. Ross, 8708 Hwy. V, Caldonia, Wis. 53108

[21] Appl. No.: 566,840

[22] Filed: Aug. 13, 1990

[51] Int. Cl.[5] ..... E41R 5/00

[52] U.S. Cl. ..... 124/88; 124/23.1

[58] Field of Search ..... 124/231, 24.1, 25.6, 124/86, 88, 35.2, 90; 272/137

[56] References Cited

U.S. PATENT DOCUMENTS

| | | | |
|---|---|---|---|
| 1,885,962 | 11/1932 | Swenson et al. | 124/23.1 |
| 3,294,078 | 12/1966 | Allen | 124/23.1 |
| 3,665,911 | 5/1972 | Altier | 124/80 X |
| 4,909,232 | 3/1990 | Carella | 124/35 A |

*Primary Examiner*—Peter M. Cuomo
*Assistant Examiner*—John A. Ricci

[57] ABSTRACT

A draw stopping device comprising a plurality of straps which are attachable to a bow on one end to an archer's wrist on the other end.

2 Claims, 1 Drawing Sheet

BOW DRAW STOP

BACKGROUND AND SUMMARY OF THE INVENTION

In its simplest form, the draw stop device comprises a strap which is attached to a bow on one end and the archer's wrist on the other end. By rigidly connecting the hand which holds the bow to the hand which draws the bow string, the bow is held rigid while the arrow is released as long as the hand holding the bow continues to push forward and the hand drawing the bow string continues to pull backward. In short, the device prevents the archer's hands from flying apart after an arrow is released.

In addition, the length of the strap determines how far the bow string is drawn so that the bow string is drawn to the same point every time. As a result of the rigidity of the system, accuracy nearer that of a crossbow may be achieved.

Several modifications of the basic form may be made to enhance the utility of the device. In the form used by the inventor, (shown in FIG. 2) two straps with adjustable lengths are attached to the bow at points which are roughly equidistant from the center of the bow and joined at their other ends with an "O" ring. A third adjustable strap is attached to the "O" ring on one end and to the adjustable wrist strap on the other end. Some means for quickly disconnecting the third strap from the wrist strap is desirable.

DESCRIPTION OF THE PREFERRED EMBODIMENT

Figure 2:
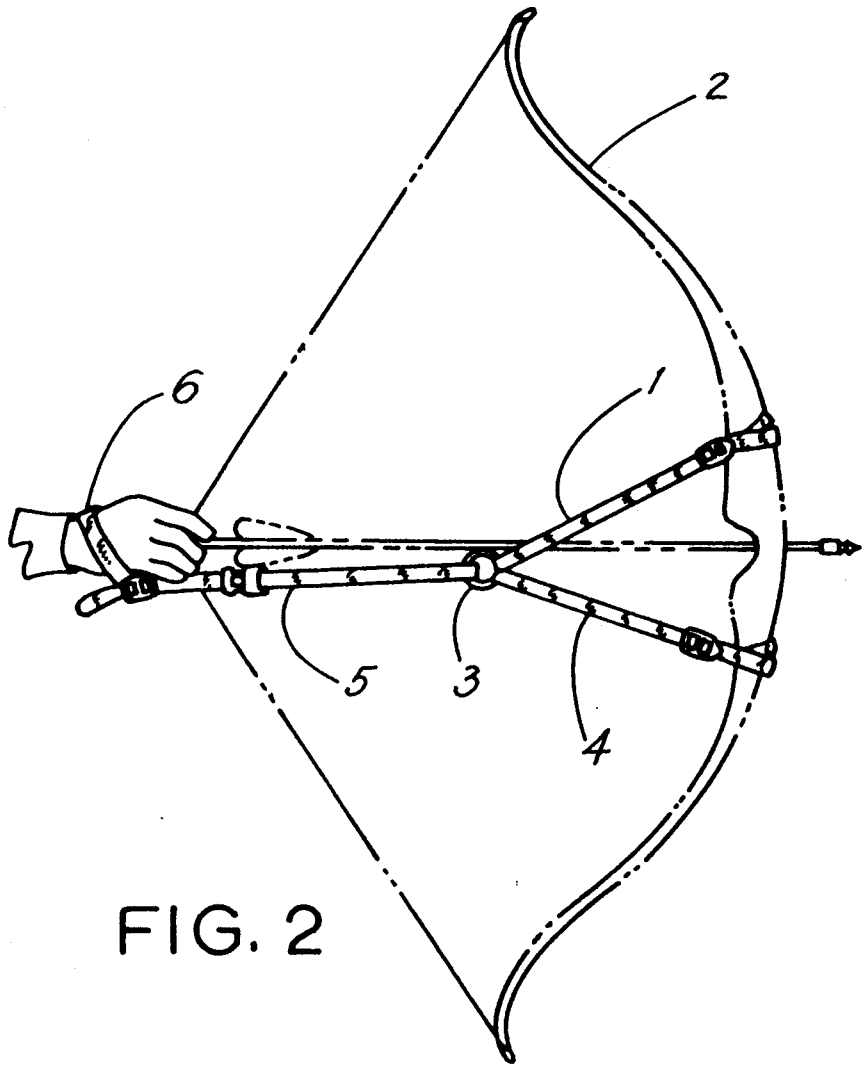
FIG. 2 shows a four-strap form of the device.
Figure 1:
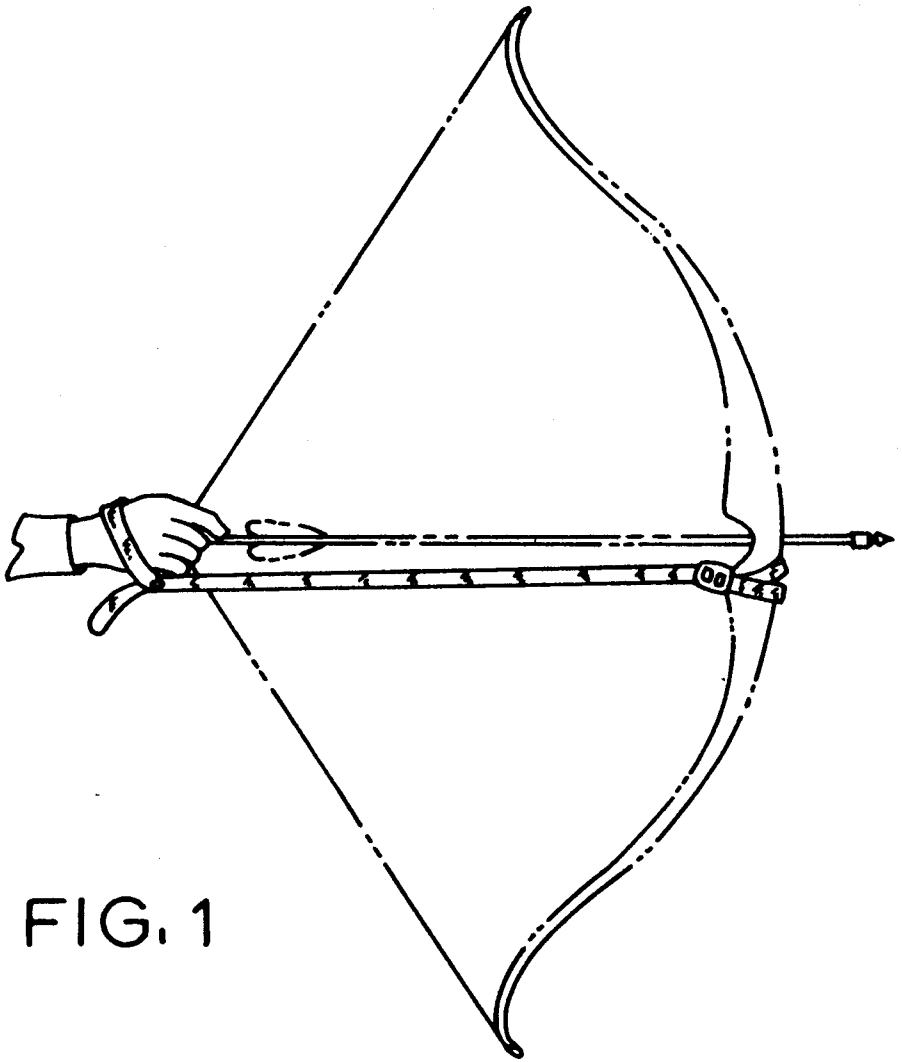
FIG. 1 shows single strap means for stopping the draw of a bow.

Referring to FIG. 2, this device comprises strap 1, which may be made of any suitable material, and the length of which may be made adjustable by any suitable means. Strap 1 is attached to a top half or upper limb of bow 2 on one end at a convenient distance from a central portion of the bow and to "O" ring 3 on the other end. Any convenient means of attachment to the bow and "O" ring may be used. Adjustable strap 4, which may be made of any suitable material, is attached on one end to a bottom half or lower limb of bow 2 at a point which is approximately the same distance from the center of the bow as is strap 1. The other end of strap 4 is attached to "O" ring 3 by any suitable means. Adjustable strap 5, which may be made of any suitable material, is also attached on a first end to "O" ring 3 and on its second end to wrist strap 6. Wrist strap 6 is an adjustable loop intended to be placed on, and adjusted to fit the user's wrist.

To use the device, an archer adjusts the length of straps 1, 4 and 5 to suit his body and also so that the point to which the bow string is drawn before releasing the arrow is roughly to the point of his chin. He then adjusts wrist strap 6 so that it fits comfortably around his wrist. From this point on, he proceeds as he normally would without the device attached.

I claim:

1. A draw stopping device for use with a bow having upper and lower limbs comprising a first strap which is removably attached to said upper limb of the bow on a first end a convenient distance from a central portion of the bow, a second strap which is removably attached to said lower limb of the bow on a first end a convenient distance from said central portion of the bow, a loop-shaped wrist strap which is removably attachable to an archer's wrist, and a third strap which is attached to the wrist strap on a first end, the first, second and third straps being joined on their second ends, the length of the first, second and third straps being such that a bow string may be drawn to a point which is approximately at the user's chin.

2. The draw stopping device as claimed in claim 1 wherein the length of the first, second, third or wrist straps is adjustable.

* * * * *